US009155973B2

(12) United States Patent
Hengel et al.

(10) Patent No.: US 9,155,973 B2
(45) **Date of Patent: *Oct. 13, 2015**

(54) PLUSH FIGURE INCLUDING MULTI-CHAMBER STORAGE SYSTEM

(71) Applicant: ZOOMWORKS LLC, Minnetonka, MN (US)

(72) Inventors: Charles M. Hengel, Woodland, MN (US); Bryan Stave, Bloomington, MN (US); Art Brown, Minnetonka, MN (US)

(73) Assignee: ZOOMWORKS LLC, Minnetonka, MN (US)

( * ) Notice: Subject to any disclaimer, the term of this patent is extended or adjusted under 35 U.S.C. 154(b) by 20 days.

This patent is subject to a terminal disclaimer.

(21) Appl. No.: 14/133,030

(22) Filed: Dec. 18, 2013

(65) Prior Publication Data

US 2014/0179193 A1 Jun. 26, 2014

Related U.S. Application Data

(60) Continuation of application No. 14/087,933, filed on Nov. 22, 2013, which is a division of application No. 13/350,144, filed on Jan. 13, 2012, now Pat. No. 8,613,639.

(60) Provisional application No. 61/559,700, filed on Nov. 14, 2011.

(51) Int. Cl.
*A63H 3/00* (2006.01)
*A63H 3/02* (2006.01)

(52) U.S. Cl.
CPC . *A63H 3/005* (2013.01); *A63H 3/02* (2013.01)

(58) Field of Classification Search
CPC ..... A63F 3/00; A63H 3/36; D05B 1/00
See application file for complete search history.

(56) References Cited

U.S. PATENT DOCUMENTS

| | | | | |
|---|---|---|---|---|
| D104,025 | S | 4/1937 | Frederick | |
| 4,917,607 | A * | 4/1990 | Van Hoose | 434/236 |
| D313,443 | S | 1/1991 | Senitt | |
| 5,885,128 | A * | 3/1999 | Blaustein et al. | 446/369 |
| D408,671 | S | 4/1999 | Bear | |
| D418,554 | S | 1/2000 | E. | |
| 6,247,730 | B1 * | 6/2001 | Henderson et al. | 281/51 |
| D532,156 | S | 11/2006 | Chen | |
| D534,223 | S | 12/2006 | Sutton | |
| D648,906 | S | 11/2011 | Byrne | |
| D681,744 | S | 5/2013 | Hengel et al. | |
| 8,613,639 | B2 | 12/2013 | Hengel et al. | |
| 2002/0144351 | A1 | 10/2002 | Fujii | |

(Continued)

*Primary Examiner* — Michael Dennis
(74) *Attorney, Agent, or Firm* — Fish & Richardson P.C.

(57) ABSTRACT

One example includes a body formed of body fabric, the body defining a body pocket opening, a body pocket disposed in an interior of the body and coupled to the body pocket opening and body plush disposed in the interior of the body, between the body pocket and the body fabric. The example includes a head formed of head fabric, the head having a posterior portion of the head coupled to the body at an anterior portion of the body, the head defining a head pocket opening disposed on an anterior portion of the head, a head pocket disposed in an interior of the head and coupled to the head pocket opening and head plush disposed in the interior of the head, between the head pocket and the head fabric. The example includes at least one pair of legs formed of leg fabric and fastened to the body.

33 Claims, 13 Drawing Sheets

(56) References Cited

U.S. PATENT DOCUMENTS

2006/0205319 A1* 9/2006 Colvin ..... 446/369
2007/0232186 A1 10/2007 Shamah
2010/0056018 A1* 3/2010 Kamar et al. ..... 446/370
2014/0076221 A1 3/2014 Hengel et al.

* cited by examiner

PLUSH FIGURE INCLUDING MULTI-CHAMBER STORAGE SYSTEM

CROSS REFERENCE TO RELATED APPLICATIONS

This application is a continuation of U.S. application Ser. No. 14/087,933 filed on Nov. 22, 2013, which is a division of U.S. application Ser. No. 13/350,144 filed Jan. 13, 2012 (now U.S. Pat. No. 8,613,639), which claims benefit of U.S. Provisional Application Ser. No. 61/559,700, filed on Nov. 14, 2011, the entire disclosures of these prior applications are incorporated herein by reference

TECHNICAL FIELD

This document relates generally to plush figures, and more particularly to a plush figures including a multi-chamber storage system.

BACKGROUND

Children enjoy plush figures or toys, such as stuffed animals, but can grow tired of playing with them. For example, if the toy fails to serve no other purpose other than resembling a familiar shape such as an animal, children become uninterested in the toy. Previous designs have incorporated a limited level of interactivity between the child and the toy, such as by providing a voice box in the toy, but such designs affect the soft nature of the toy, which can hamper the toy's suitability as a soft cushion for a child to rest on. Interest remains in providing an improved level of interactivity while preserving the toy's fitness as a cushion for a resting child.

BRIEF DESCRIPTION OF THE DRAWINGS

The drawings illustrate generally, by way of example, various embodiments discussed in the present document. The drawings are for illustrative purposes only and may not be to scale.

DETAILED DESCRIPTION

The present subject matter provides an improved plush toy that provides an increased level of interactivity for children. Examples allow children to hide articles in multiple places, thereby providing them with many opportunities to configure and reconfigure the location of their belongings inside a storage apparatus. Various examples provide a multi-chamber storage system that doubles as a plush that can be sized to comfortably receive a child's embrace. Some examples provide toys that are configurable in manufacture and distribution to provide a modular product range to feasibly allow children to form a collection. Some examples provide concealed articles that are revealed only after purchase. Some examples randomize a set of articles so that, from toy to toy, the concealed article to be revealed upon purchase varies. These and other benefits are discussed further herein.

Figure 1A:
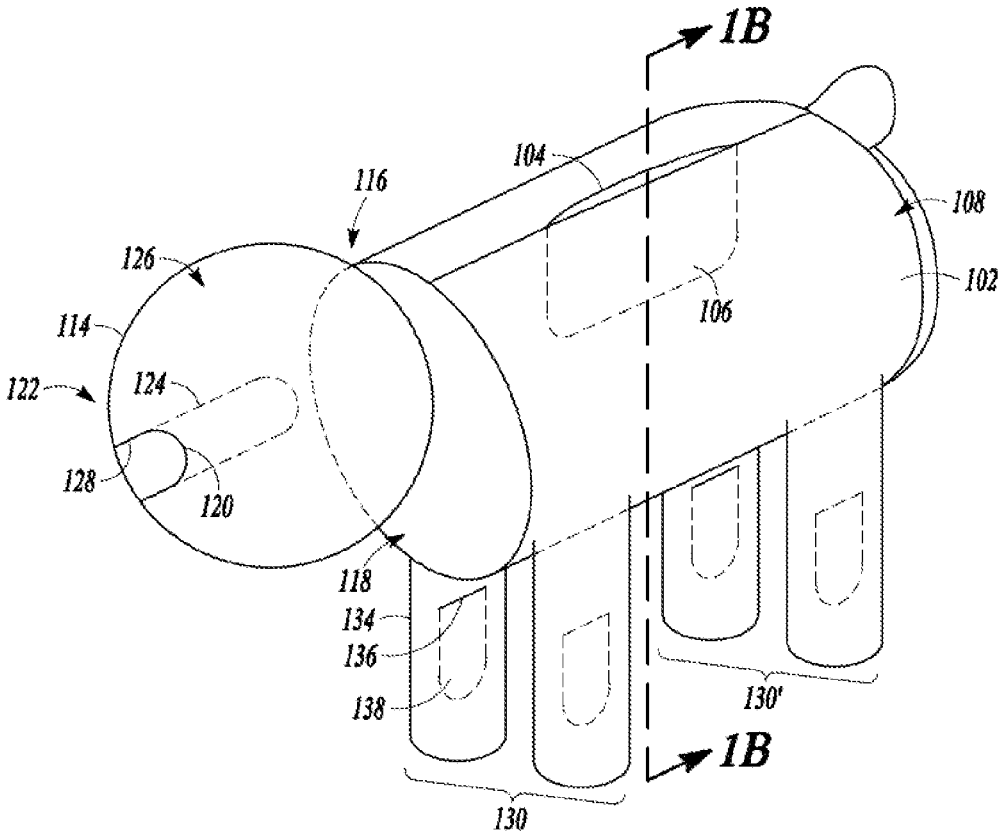
FIG. 1A is a perspective view of a plush toy including multiple storage compartments, according to an example.
Figure 1B:
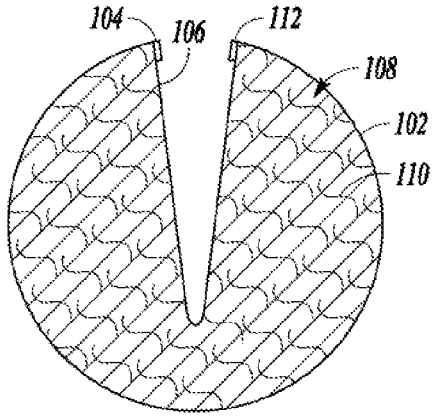
FIG. 1B is a cross-sectional view of the plush toy of FIG. 1A.
Figure 2A:
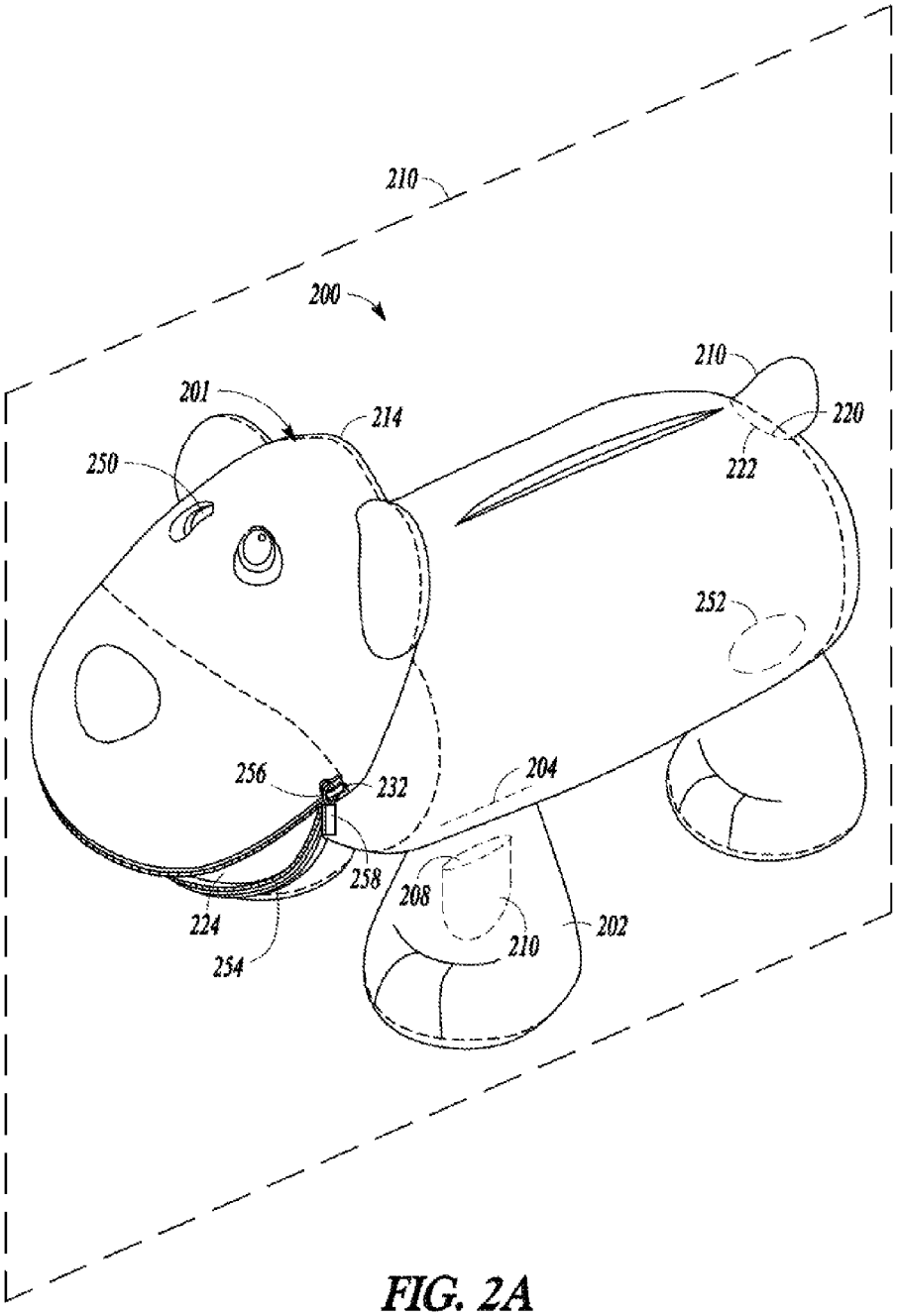
FIG. 2A is a perspective view of a plush toy including multiple storage compartments showing details, according to an example.
Figure 2B:
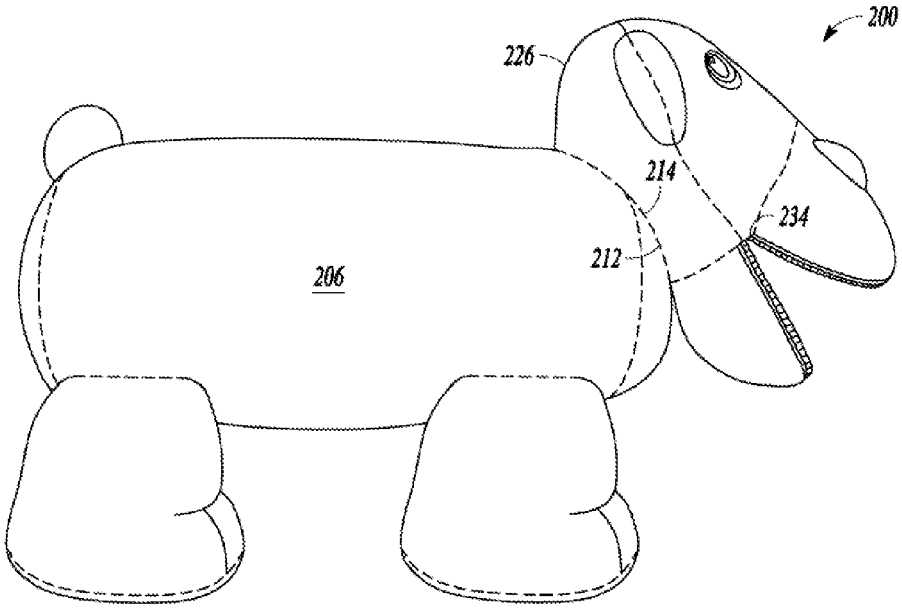
FIG. 2B is a right side view of a plush toy including multiple storage compartments showing details, according to an example.
Figure 2C:
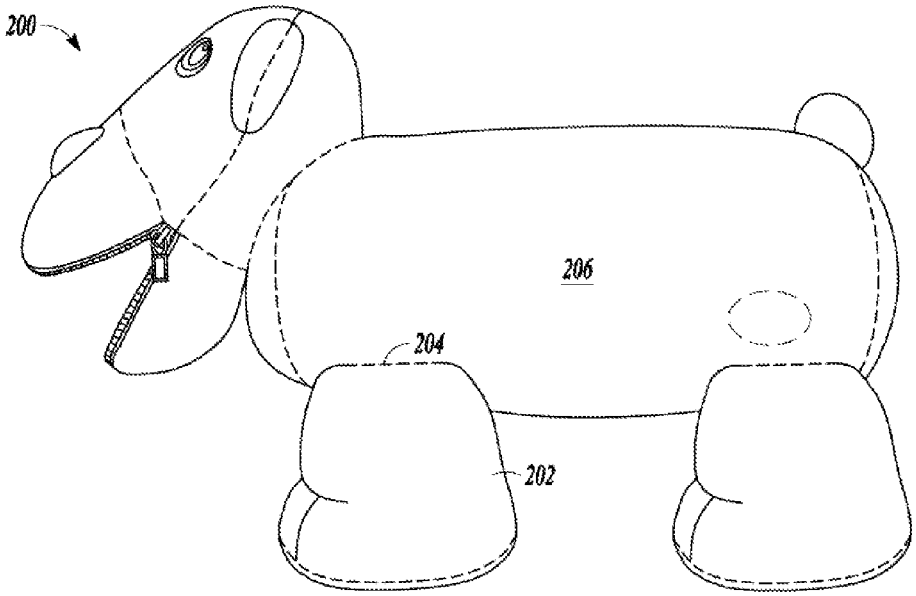
FIG. 2C is a left side view of a plush toy including multiple storage compartments showing details, according to an example.
Figure 2D:
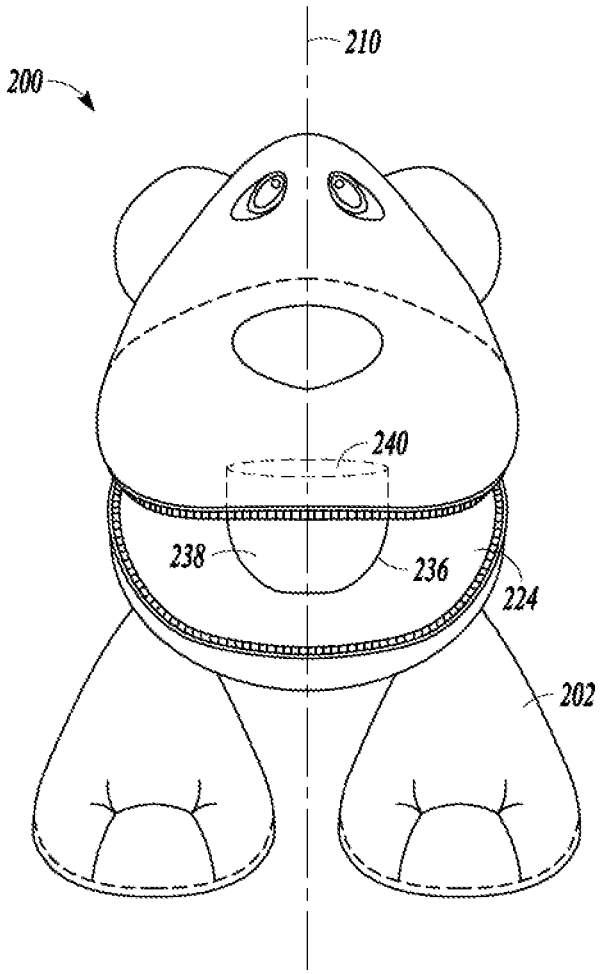
FIG. 2D is a front view of a plush toy including multiple storage compartments showing details, according to an example.
Figure 2E:
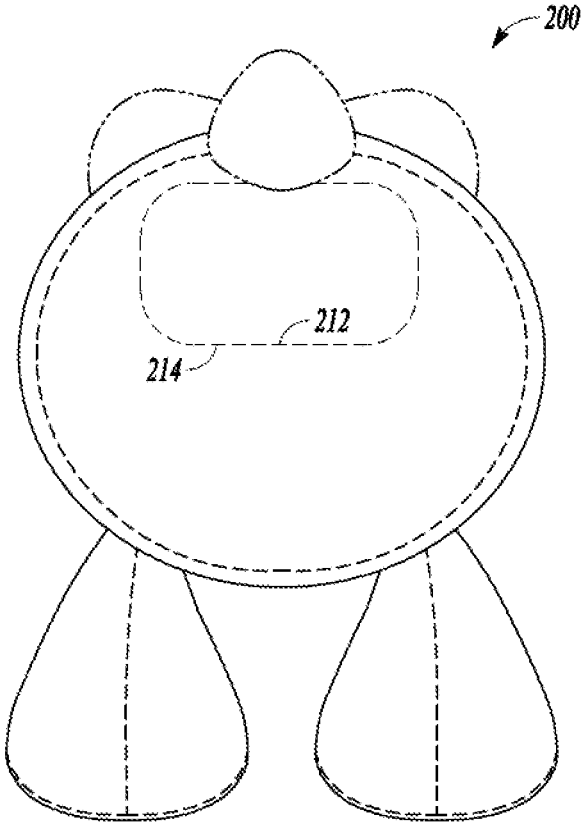
FIG. 2E is a back view of a plush toy including multiple storage compartments showing details, according to an example.
Figure 2F:
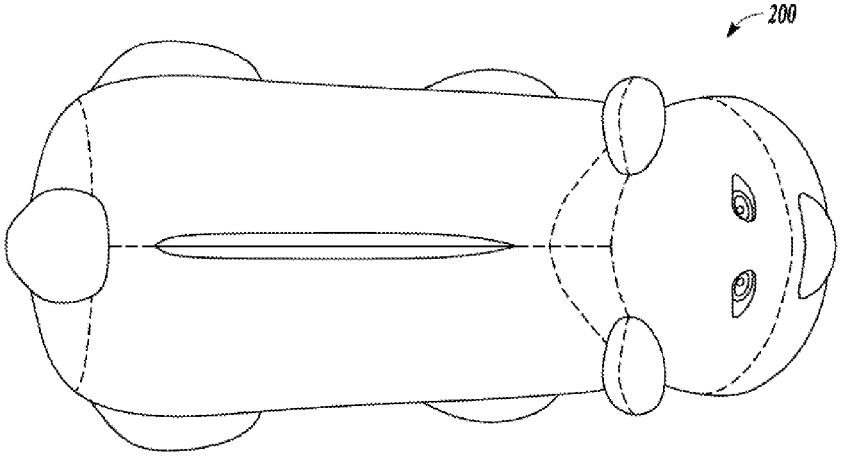
FIG. 2F is a top view of a plush toy including multiple storage compartments showing details, according to an example.
Figure 2G:
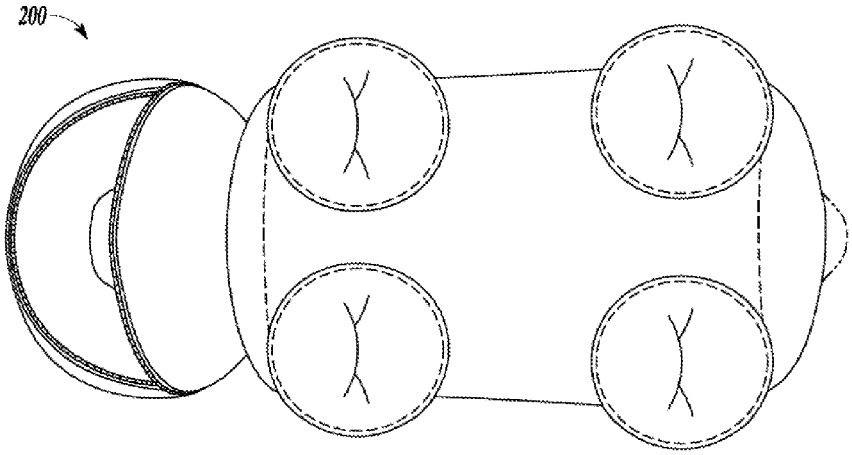
FIG. 2G is a bottom view of a plush toy including multiple storage compartments showing details, according to an example.

FIG. 1 is a perspective view of a plush toy including multiple storage compartments, according to an example. One example includes a body 102. In some examples, the body is formed of body fabric. Examples of fabrics as used herein include, but are not limited to, polyester, including soft boa, such as soft boa formed of polyester. Some examples are formed of 100% polyester. Some examples use soft boa of a length of 5 millimeters and a width of around 1.47 meters (58 inches).

In various examples, the body defines a body pocket opening 104. In some examples, a body pocket 106 is disposed in an interior 108 of the body 102 and coupled to the body pocket opening 104.

Some examples include body plush 110 disposed in the interior 108 of the body, such as between the body pocket 106 and the body fabric. In some examples, a recloseable body fastener 112 is coupled to the body 102 proximal or near the body pocket opening 104. In some examples, the recloseable body fastener 112 is configured to fasten the body pocket opening 104 closed, such as by sealing it closed. Examples of recloseable fasteners as used herein include, but are not limited to, hook-and-loop, snaps, zippers, zip-lock seals, magnets and other fasteners. In some examples use hook-and-loop fasteners formed of nylon.

Some examples include a head 114. Various examples are formed of head fabric. Examples of head fabric include those recited with respect to the body fabric. In various examples the head has a posterior portion 116 that is coupled to the body at an anterior portion 118 of the body. In various examples, the head 114 defines a head pocket opening 120 disposed on an anterior portion 122 of the head 114. In various examples, the head pocket 124 disposed in an interior of the head and coupled to the head pocket opening head plush disposed in the interior of the head 126, such as between the head pocket and the head fabric. Various examples include a recloseable head fastener 128 coupled to the head proximal the head pocket opening and configured to fasten the head pocket opening closed.

Some examples include at least one pair of legs 130 formed of leg fabric. In various examples, respective pairs of legs are fastened to the body, such as bilaterally, such as along a ventral portion 132 of the body 102. In various examples, at least one leg 134 of the pair of legs 130 includes a leg fabric configured in a leg that defines a leg pocket opening 136. In various examples, a leg pocket 138 is disposed in the interior of the leg and coupled to the leg opening leg plush disposed in the interior of the leg between the leg pocket and the leg and a recloseable leg fastener coupled to the leg proximal the leg opening to close the leg opening.

Various options are contemplated. One or more additional pairs of legs 130' can be attached to the body 102, such as bilaterally, such as along a ventral portion 132 of the body 102. In some examples, the head 114, the body 102 and legs 130, 130' together define a quadruped shape. Examples of quadruped shapes include, but are not limited to, a dog, a horse, a giraffe, a dinosaur, a turtle, a unicorn, a hippopotamus, a bear, a pig, a monkey and a bee. Other shapes are contemplated. An example of a bear is depicted in FIGS. 2A-G.

In various openings, the body pocket opening is positioned dorsally on the body. Examples are included, wherein the body includes a dorsal seam extending dorsally along the body. Examples are included wherein the body pocket opening is formed by the dorsal seam extending dorsally along the body. Examples are included wherein the body is cylinder shaped, with a single seam extending dorsally, with an anterior seam disposed along an anterior portion of the body, and a posterior seam disposed along a posterior portion of the body. Examples are included wherein the cylinder shape is a right circular cylinder shape. Examples are included wherein the anterior seam is circular. Examples are included wherein the posterior seam is circular.

FIGS. 2A-G provide views of a plush toy 200 including multiple storage compartments showing details, according to an example. In the figures, the dashed lines indicate optional stitching. Various examples show a head 201 coupled to a body 206. In various examples, a leg 202 includes a top leg seam 204. In various examples, the top leg seam retains the leg plush inside the leg. In some examples, the leg seam 204 separates leg plush from body plush. In some examples, the leg 202 is coupled to the body 206 at the leg seam 204. Examples are included wherein the leg pocket opening 208 faces a sagittal plane 210 of the body 206. Examples are included wherein the body 206 defines an anterior opening 212 and the head 201 defines a head opening 214 that coupled to the anterior opening 212 of the body 206. Examples are included wherein the body plush extends through the head opening 214 in communication with the head 201.

Various examples include a tail 216 coupled to the body 206, such as posteriorly. Examples are included wherein the body 206 defines a posterior opening 220 and the tail 216 defines a tail opening 222 that coupled to the posterior opening of the body. Examples are included wherein the body plush extends through the tail opening in communication with an interior volume of the tail.

In certain examples one or more eyes 250 are coupled to the head 201. In certain examples, the eyes 250 are formed of polyester. In some examples, the eyes 250 are formed for brushed tricot. In certain examples one or more logos 252 are coupled to the body 206. In certain examples, a logo 252 is formed of polyester. In some examples, one or more eyes 250 are formed of woven label.

Examples are included wherein the head pocket opening 224 is formed in a shape of a mouth. Various examples include a bottom head portion 226 coupled with the body 206 along a neck seam 228. A top head portion 230 is coupled to the bottom head portion 226. In various examples, the top head portion 230 and the bottom head portion 226 define the mouth opening. In some examples, the bottom head portion 226 is standardized across multiple shapes, including, but not limited to, a dog, a horse, a giraffe, a dinosaur, a turtle, a unicorn, a hippopotamus, a bear, a pig, a monkey and a bee. Other shapes are contemplated.

Examples are included wherein the mouth opening 224 extends from a first corner 232 on one side of the head to a second corner 234 on an opposite side of the head. Examples are included wherein the top head portion 230 and the bottom head portion 226 are hinged between the first corner and the second corner.

Examples are included wherein the recloseable head fastener includes a zipper 254. Examples are included wherein the zipper is oriented to resemble teeth of the mouth. In some examples, the zipper slider is formed of polyoxymethylene. In some examples, the zipper pull is formed of polyoxymethylene. In some examples, the zipper includes a soft pull 256, such as one include cord or chain 256 with material 258, such as felt or fleece, coupled onto the cord 256, such as through sewing, welding or gluing, although other pulls are possible. Such a material gives the head 201 and overall soft feel suitable for cushioning a person's head or body.

Various examples include a tongue 236 coupled to the head on a ventral surface 238 of the mouth 224. Examples are included wherein the tongue defines a tongue pocket 238 with a tongue pocket opening 240 oriented posteriorly. In some examples, the tongue 236 is formed of brushed tricot.

Figure 3:
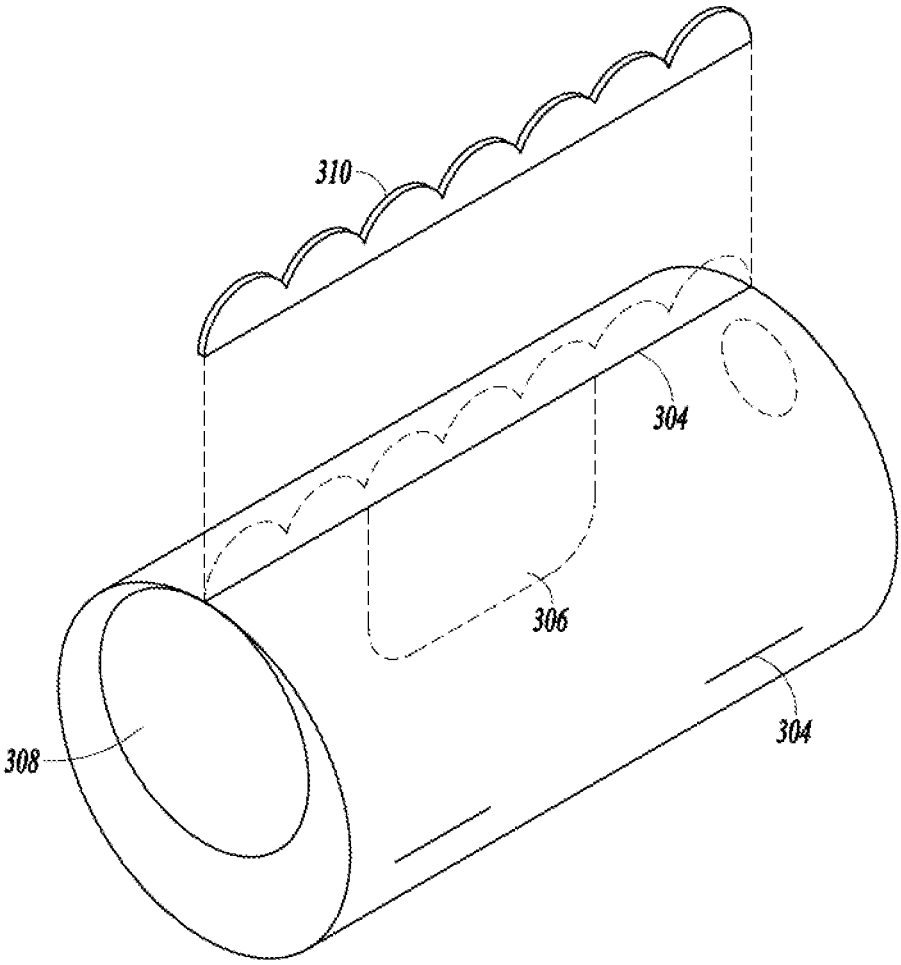
FIG. 3 is a perspective view of a plush toy torso including a storage compartment, according to an example.

FIG. 3 is a perspective view of a plush toy torso including a storage compartment, according to an example. A body 302 is shown without a head or legs attached. A dorsal seam 304 is pictured. According to some examples, a body pocket 306 is coupled into the body. An anterior body opening 308, such as for coupling with a head, is included in some examples.

Examples are included wherein the top leg seam 304 is a substantially linear top leg seam. Examples are included wherein the substantially linear top leg seam is approximately parallel to a sagittal plane of the body.

Various examples include an optional fin 310 couplable to the body along the dorsal seam. Material resembling other animal aspects, such as a horse mane, can alternatively be coupled dorsally into the top seam. The present subject matter is not limited to embodiments in which the seam 304 is located dorsally, and extends to other examples, such as those in which the seam is located ventrally or elsewhere.

Figure 4A:
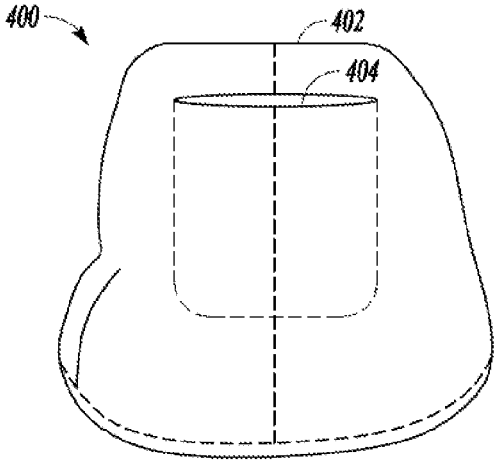
FIG. 4A is a side view of a plush toy leg including a storage compartment, according to an example.
Figure 4B:
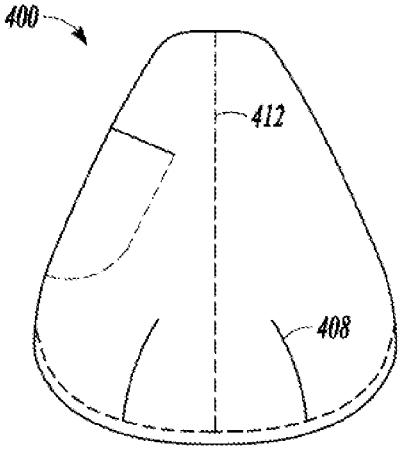
FIG. 4B is a front view of the toy of FIG. 4A.
Figure 4C:
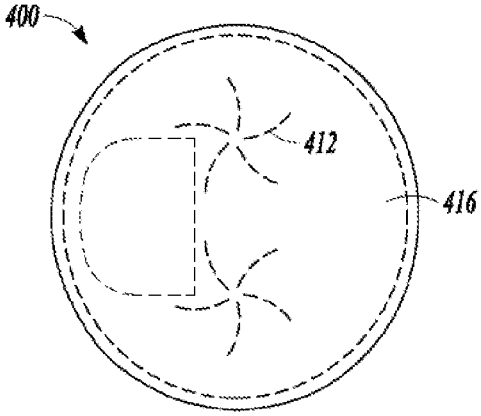
FIG. 4C is a bottom view of the toy of FIG. 4A.

FIG. 4A is a side view of a plush toy leg including a storage compartment, according to an example. FIG. 4B is a front view of the toy of FIG. 4A. FIG. 4C is a bottom view of the toy of FIG. 4A. In various examples, a leg 400 includes a top seam 402, such as to retain plush inside the leg 400. Various leg examples include fabric defining a leg pocket opening 404 that extends to a leg pocket 406. Pockets include pocket-shape material coupled to an exterior fabric (i.e., skin fabric). Some pocket examples are sewn out of exterior fabric.

In some examples, at least one leg 400 of a toy includes stitching 408 to bulge the leg along an anterior surface into the shape of at least two adjacent paw digits. Examples are included wherein the at least one of the legs includes a bottom portion 410, with stitching 412 extending from the bottom portion to an interior portion of the leg to maintain the bottom portion in a generally planar shape with respect to a remainder of the at least one of the legs.

Various systems and methods can use legs other than those pictured, including, but not limited to, flippers, hooves, mismatched legs (i.e., frog legs or tyrannosaurus legs), and the like. In various examples, each leg style is couplable to a standard body. In some examples, numerous combinations of legs, bodies, and heads can be made without retooling or retraining manufacturing processes.

Figure 5:
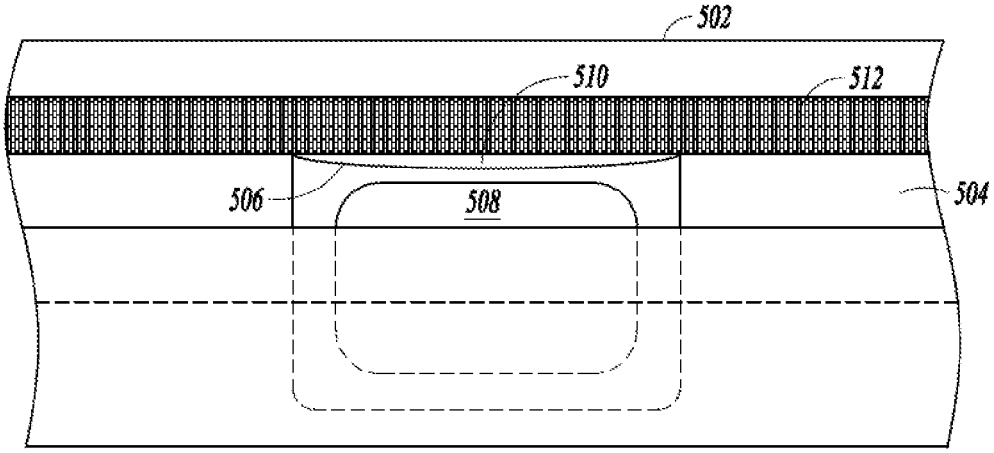
FIG. 5 is a top view of a plush toy torso including a storage compartment and an identification compartment, according to an example.

FIG. 5 is a top view of a plush toy torso including a storage compartment and an identification compartment, according to an example. A body 502 includes a pocket 504 that includes an identification pocket 506. In some examples, the identification pocket 506 is formed of polyvinylchloride. In some examples, an identification pocket 506 includes a transparent portion 508. In some examples, the identification pocket is formed of a generally stiff, flexible material. In some examples, the identification pocket 506 is formed into a substantially planar shape. In various examples, the identification pocket 506 is disposed in the body pocket 504, with an identification pocket opening 510 of the identification pocket 506 coupled proximal the body pocket opening.

Various fasteners are contemplated to couple the body pocket closed. Hook-and-loop style material 512 is illustrated, but the present subject matter can optionally include snaps, magnets and the like.

Figure 6:
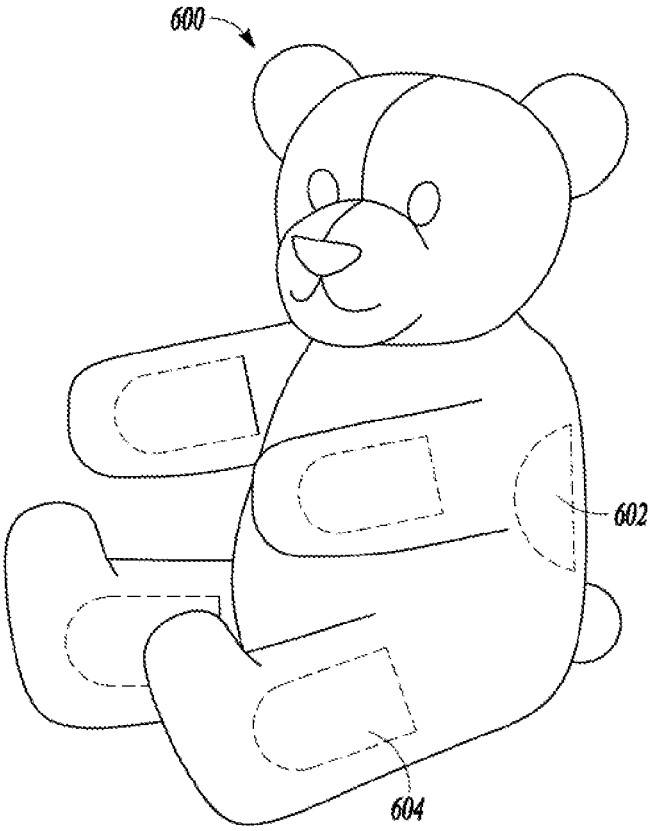
FIG. 6 is a perspective view of a plush toy of another shape and including multiple storage compartments showing head details, according to an example.

FIG. 6 is a perspective view of a plush toy of another shape and including multiple storage compartments showing head details, according to an example. A toy 600 includes a body pocket 602 and one or more leg pockets 604. The illustrated example does not include the top leg seam feature of other examples discussed here, which is to say that each leg shares an open interface with the body such that plush extends through the opening. Such a configuration results in manufacturing complexity that results in increased cost for the consumer. For example, to have 12 different toys, with each having unique legs, body, and head, 12 different body sewing processes will be incorporated into manufacturing, and 12 separate inventories of parts will be stored. To reduce complexity, the other embodiments discussed here use common parts and standard manufacturing methods.

Figure 7:
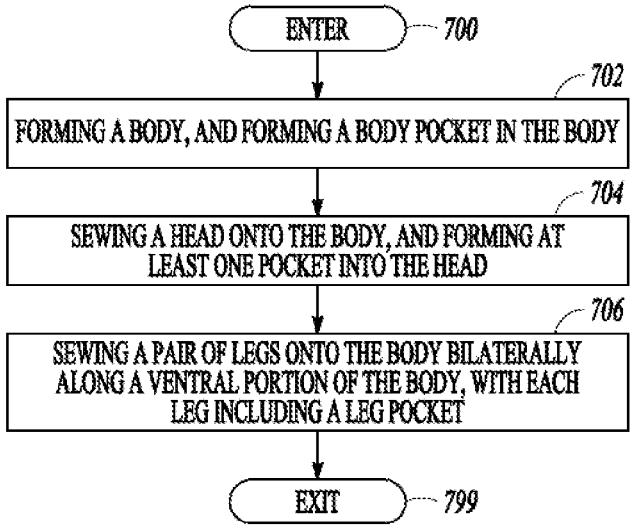
FIG. 7 is a method of forming a plush toy, according to an example.

FIG. 7 is a method of forming a plush toy, according to an example. The method starts at 700. At 702, the method includes forming a body. Forming a body can include optional steps, including, but not limited to, excising body fabric and coupling the body fabric into a body shape. As used herein, coupling can include one or more of sewing, welding, gluing and the like. Some optional steps include coupling a body pocket into the body shape, the pocket extending to a body pocket opening in the body fabric, coupling the body fabric into a body, with the body pocket disposed in an interior of the body, coupling a body pocket fastener to the body proximal the body pocket opening, the body pocket fastener for maintaining the body pocket opening closed and stuffing the body with body plush to fill the interior of the body.

At 704, the method includes coupling a head onto the body. Forming the head can include one or more optional steps, including, but not limited to, excising head fabric, coupling the head fabric into a head shape, coupling a head pocket into the head shape, the pocket extending to an head pocket opening in the head fabric, coupling the head fabric into a head, with the head pocket disposed in an interior of the head and coupling a head pocket fastener to the head proximal the head pocket opening, the head pocket fastener for maintaining the head pocket opening closed. Some examples include stuffing the head with head plush to fill the interior of the head.

At 706, the method includes coupling a pair of legs onto the body bilaterally along a ventral portion of the body. In various examples, at least one leg formed by one or more optional steps, including, but not limited to, excising leg fabric, coupling the leg fabric into a leg shape, coupling a leg pocket into the leg shape, the pocket extending to an leg pocket opening in the leg fabric, coupling the leg fabric into a leg, with the leg pocket disposed in an interior of the leg and coupling a leg pocket fastener to the leg proximal the leg pocket opening, the leg pocket fastener for maintaining the leg pocket opening closed. Some examples include stuffing the leg with leg plush to fill the interior of the leg.

Examples are included wherein excising the body fabric comprises excising an anterior opening in the body, such as for attachment to a tail via a tail interface. In some examples, plush extends from a body, through a tail interface and into a tail.

Examples are included wherein excising the head fabric comprises excising a posterior opening in the head and wherein coupling the head onto the body includes coupling such that the anterior opening in the body and the posterior opening in the head are substantially coextensive, with plush extending from the head into the body. Various examples include stuffing each of the legs with leg plush separately contained from the plush of the head and the body. Examples are included wherein coupling the body fabric into a body includes defining a head opening. Various examples include coupling the leg plush into the leg before attaching the leg to the body. Various examples include coupling a bottom head portion onto the body fabric. Various examples include coupling extra fabric along a dorsal seam. The method ends at 799.

Figure 8:
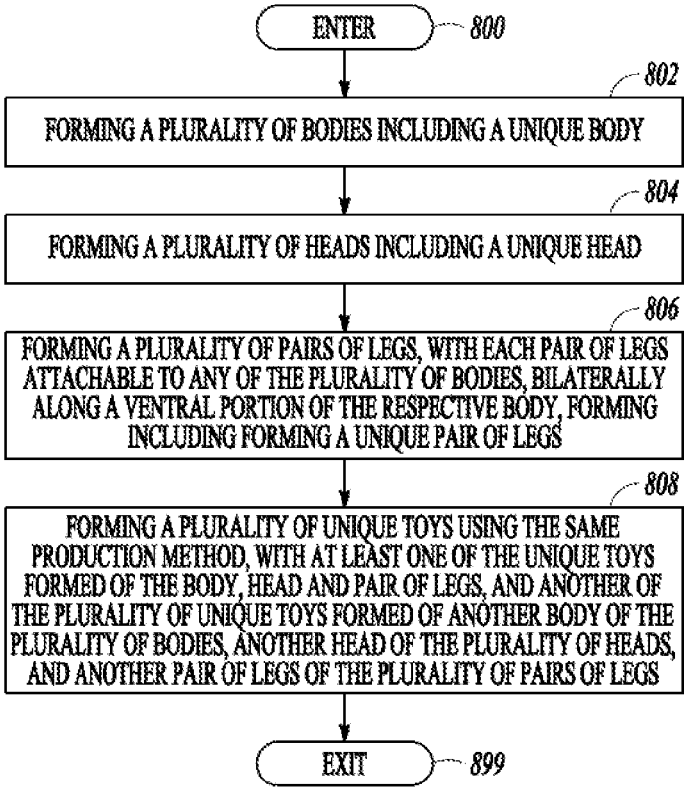
FIG. 8 is a method of producing a plurality of toys, according to an example.

FIG. 8 is a method of producing a plurality of toys, according to an example. At 800, the method begins. At 802, the method includes forming a plurality of bodies. In various examples, the method includes forming a plurality includes at least one unique body. An example of a unique body is one having a fabric color or texture differing from the remainder of the plurality. In one example, a plurality includes several different fabric colors, wherein a unique body resembles the pattern of a cheetah, giraffe or other pattern. In some examples, unique bodies are identified with a code, such as a serialized code. In some example, such a code is machine readable, such that a machine can recognize a code, and direct the unique body to a manufacturing process for assembly to selected unique head, legs, a tail or other appendages. Some methods match the appearance of several unique body pieces, such as via sorting into batches for assembly.

In various examples, a body is formed by one or more optional steps, including, but not limited to, excising unique body fabric, coupling a body pocket into the body, the pocket extending to a body pocket opening in the body fabric, coupling the body fabric into a body, with the body pocket disposed in an interior of the body, coupling a body pocket fastener to the body proximal the body pocket opening, the body pocket fastener for maintaining the body pocket opening closed and stuffing the body with body plush to fill the interior of the body.

At 804, the method includes forming a plurality of heads, each head attachable to each of the plurality of bodies. In some examples, the plurality of heads includes at least one unique head. In various examples, a head is formed by one or more optional steps, including, but not limited to, excising head fabric, coupling a head pocket into the head, the pocket extending to an head pocket opening in the head fabric, coupling the head fabric into a head, with the head pocket disposed in an interior of the head and coupling a head pocket fastener to the head proximal the head pocket opening, the head pocket fastener for maintaining the head pocket opening closed. Various examples include stuffing the head with head plush to fill the interior of the head.

At 806, the method includes forming a plurality of pairs of legs. Examples are included in which each pair of legs is attachable to any of a plurality of bodies, such as bilaterally, such as along a ventral portion of a respective body. In various examples, a leg is formed by one or more optional steps, including, but not limited to, excising leg fabric, coupling a leg pocket into the leg, the pocket extending to an leg pocket opening in the leg fabric, coupling the leg fabric into a leg, with the leg pocket disposed in an interior of the leg and coupling a leg pocket fastener to the leg proximal the leg pocket opening, the leg pocket fastener for maintaining the leg pocket opening closed. Some examples include stuffing the leg with leg plush to fill the interior of the leg. Examples are included wherein each leg of the plurality of legs is sewn to maintain plush inside the leg before attachment to a body of the plurality of bodies. The method ends at 899.

Figure 9:
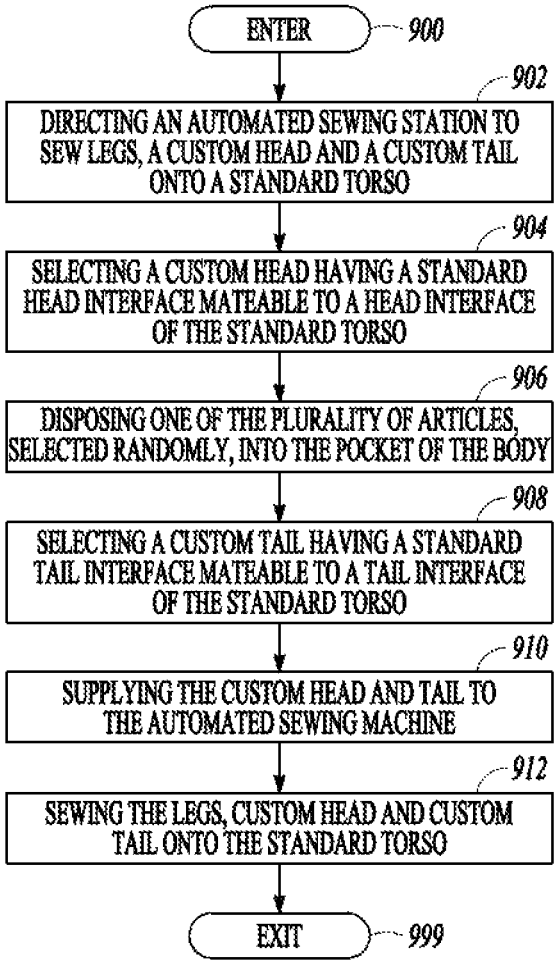
FIG. 9 is a method of using automated machinery to form a toy, according to an example.

FIG. 9 is a method of using automated machinery to form a toy, according to an example. The method starts at 900. At 902, the method includes directing an automated coupling station to sew legs, a custom head and a custom tail onto a standard torso. At 904 the method includes selecting a custom head having a standard head interface mateable to a head interface of the standard torso. At 906, the method includes selecting a custom tail having a standard tail interface mateable to a tail interface of the standard torso. At 908, the method includes supplying the custom head and tail to the automated coupling machine. At 908, the method includes coupling the legs, custom head and custom tail onto the standard torso. The method ends at 999.

Examples are included wherein the legs are custom legs including respective leg interfaces mateable to a matching standard leg interface of the standard torso. Various examples include coupling plush into each of the legs, the plush contained in each of the legs, prior to coupling the legs onto the standard torso.

Figure 10:
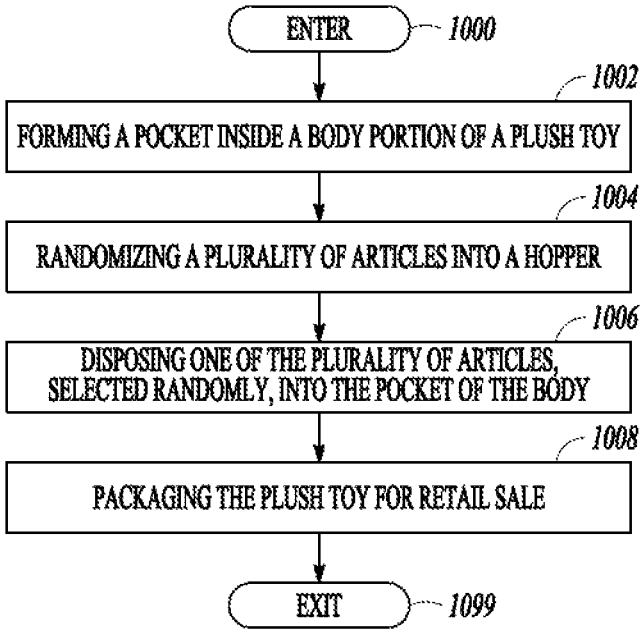
FIG. 10 is a method of selecting a random article for disposition inside a toy, according to an example.

FIG. 10 is a method of selecting a random article for disposition inside a toy, according to an example. At 1000, the method begins. At 1002, the method includes forming a pocket inside a body portion of a plush toy. At 1004, the method includes randomizing a plurality of articles into a hopper. At 1006, the method includes disposing one of the plurality of articles, selected randomly, into the pocket of the body. At 1008, the method includes packaging the plush toy for retail sale.

Various examples include disposing another of the plurality of articles into a leg pocket of the plush toy. Various examples include disposing another of the plurality of articles into a head pocket of the plush toy. Examples are included wherein packaging the plush toy comprises covering the pocket of the body with packaging material.

Figure 11:
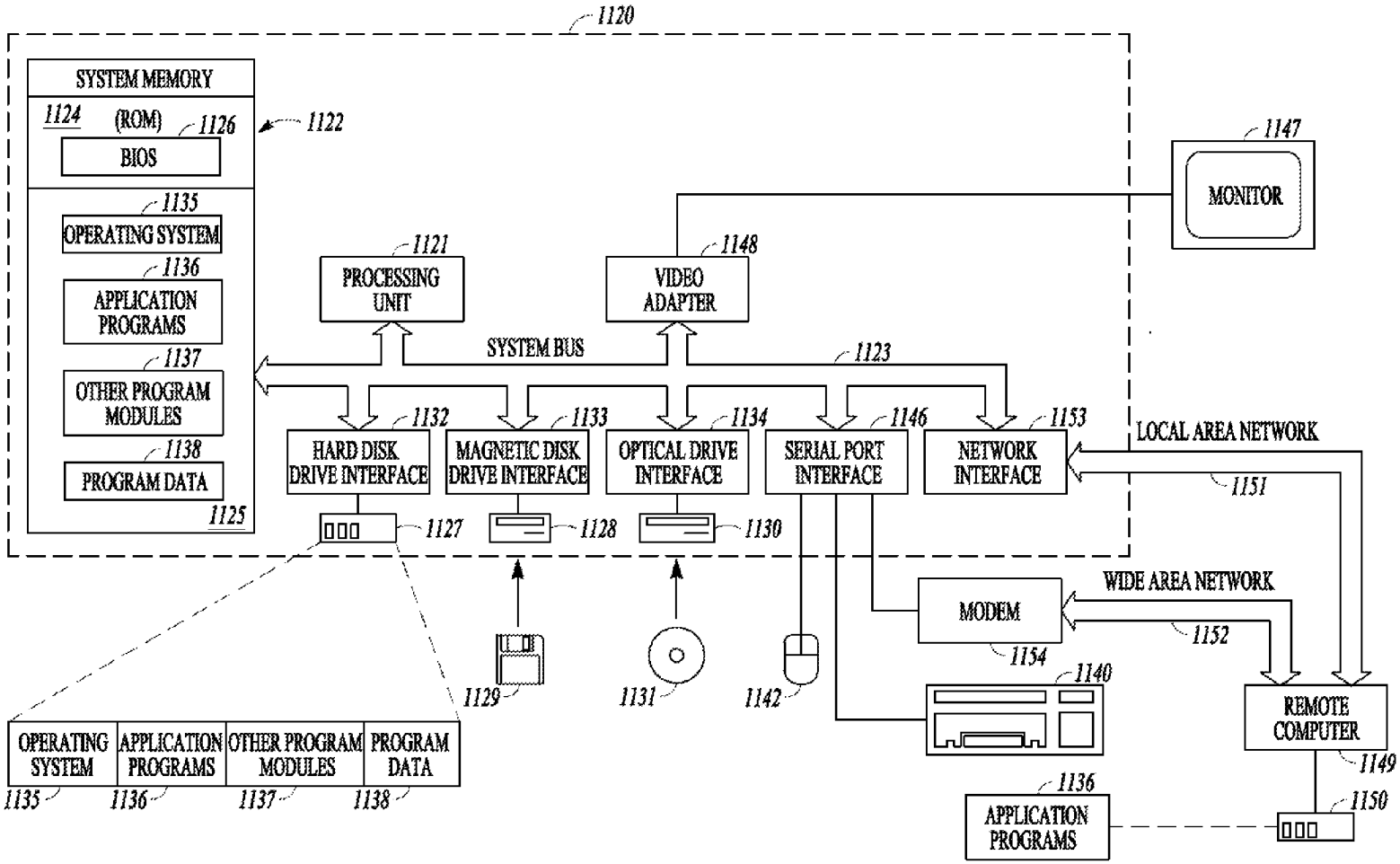
FIG. 11 is a block diagram of a computer system to implement methods according to an example embodiment.

FIG. 11 is a block diagram of a computer system to implement methods according to an example embodiment. In the embodiment shown in FIG. 11, a hardware and operating environment is provided that is applicable to performing methods disclosed here, such as by facilitating one or more method referenced in the discussion of FIGS. 7-10.

As shown in FIG. 11, one embodiment of the hardware and operating environment includes a general purpose computing device in the form of a computer 1100 including one or more processing units 1121, a system memory 1122, and a system bus 1123 that operatively couples various system components including the system memory 1122 to the processing unit 1121. There can be only one or there can be more than one processing unit 1121, such that the processor of computer 1100 comprises a single central-processing unit (CPU), or a plurality of processing units, commonly referred to as a multiprocessor or parallel-processor environment.

The system bus 1123 can be any of several types of bus structures including a memory bus or memory controller, a peripheral bus, and a local bus using any of a variety of bus architectures. The system memory can also be referred to as simply the memory, and, in some embodiments, includes read-only memory (ROM) 1124 and random-access memory (RAM) 1125. A basic input/output system (BIOS) program 1126, containing the basic routines that help to transfer information between elements within the computer 1100, such as during start-up, can be stored in ROM 1124. The computer 1100 can include a hard disk drive 1127 for reading from and writing to a hard disk, not shown, a flash memory device 1128 for reading from or writing to a removable flash memory storage device 1129, and an optical disk drive 1130 for reading from or writing to a removable optical disk 1131 such as a CD ROM or other optical media.

The hard disk drive 1127, flash memory storage device 1128, and optical disk drive 1130 couple with a hard disk drive interface 1132, a flash memory storage device interface 1133, and an optical disk drive interface 1134, respectively. The drives and their associated computer-readable media provide non volatile storage of computer-readable instructions, data structures, program modules and other data for the computer 1100. It should be appreciated by those skilled in the art that any type of computer-readable media which can store data that is accessible by a computer, such as magnetic cassettes, flash memory cards, digital video disks, Bernoulli cartridges, random access memories (RAMs), read only memories (ROMs), redundant arrays of independent disks (e.g., RAID storage devices) and the like, can be used in the exemplary operating environment.

A plurality of program modules can be stored on the hard disk, flash memory storage device 1129, optical disk 1131, ROM 1124, or RAM 1125, including an operating system 1135, one or more application programs 1136, other program modules 1137, and program data 1138. Programming for implementing one or more processes or method described herein can be resident on any one or number of these computer-readable media.

A user can enter commands and information into computer 1100 through input devices such as a keyboard 1140 and pointing device 1142. Other input devices (not shown) can include a microphone, joystick, game pad, satellite dish, scanner, or the like. These other input devices are often connected to the processing unit 1121 through a serial port interface 1146 that is coupled to the system bus 1123, but can be connected by other interfaces, such as a parallel port, game port, or a universal serial bus (USB). A monitor 1147 or other type of display device can also be connected to the system bus 1123 via an interface, such as a video adapter 1148. The monitor 1147 can display a graphical user interface for the user. In addition to the monitor 1147, computers typically include other peripheral output devices (not shown), such as speakers and printers.

The computer 1100 can operate in a networked environment using logical connections to one or more remote computers or servers, such as remote computer 1149. These logical connections are achieved by a communication device coupled to or a part of the computer 1100; the invention is not limited to a particular type of communications device. The remote computer 1149 can be another computer, a server, a router, a network PC, a client, a peer device or other common network node, and typically includes many or all of the elements described above input/output relative to the computer 1100, although only a memory storage device 1150 has been illustrated. The logical connections depicted in FIG. 11 include a local area network (LAN) 1151 and/or a wide area network (WAN) 1152. Such networking environments are commonplace in office networks, enterprise-wide computer networks, intranets and the internet, which are all types of networks.

When used in a LAN-networking environment, the computer 1100 is connected to the LAN 1151 through a network interface or adapter 1153, which is one type of communications device. In some embodiments, when used in a WAN-networking environment, the computer 1100 typically includes a modem 1154 (another type of communications device) or any other type of communications device, e.g., a wireless transceiver, for establishing communications over the wide-area network 1152, such as the internet. The modem 1154, which can be internal or external, is connected to the system bus 1123 via the serial port interface 1146. In a networked environment, program modules depicted relative to the computer 1100 can be stored in the remote memory storage device 1150 of remote computer, or server 1149. It is appreciated that the network connections shown are exemplary and other means of, and communications devices for, establishing a communications link between the computers can be used including hybrid fiber-coax connections, T1-T3 lines, DSL's, OC-3 and/or OC-12, TCP/IP, microwave, wireless application protocol, and any other electronic media through any suitable switches, routers, outlets and power lines, as the same are known and understood by one of ordinary skill in the art.

EXAMPLES AND NOTES

Example 1 includes an apparatus that includes a body formed of body fabric, the body defining a body pocket opening; a body pocket disposed in an interior of the body and coupled to the body pocket opening; body plush disposed in the interior of the body, between the body pocket and the body fabric; a recloseable body fastener coupled to the body proximal the body pocket opening and configured to fasten the body pocket opening closed; a head formed of head fabric, the head having a posterior portion of the head coupled to the body at an anterior portion of the body, the head defining a head pocket opening disposed on an anterior portion of the head; a head pocket disposed in an interior of the head and coupled to the head pocket opening; head plush disposed in the interior of the head, between the head pocket and the head fabric; a recloseable head fastener coupled to the head proximal the head pocket opening and configured to fasten the head pocket opening closed; and at least one pair of legs formed of leg fabric and fastened to the body bilaterally along a ventral portion of the body, wherein at least one leg of the pair of legs includes: a leg fabric configured in a leg that defines a leg pocket opening; a leg pocket disposed in the interior of the leg and coupled to the leg opening; leg plush disposed in the interior of the leg between the leg pocket and the leg; and a recloseable leg fastener coupled to the leg proximal the leg opening to close the leg opening.

Example 2 can optionally include the subject matter of Example 1, wherein the leg includes a top leg seam that retains the leg plush inside the leg and separates the leg plush from the body plush.

Example 3 can optionally include the subject matter of Example 2, wherein the leg is coupled to the body at the top leg seam.

Example 4 can optionally include the subject matter of Example 2, wherein the top leg seam is a substantially linear top leg seam.

Example 5 can optionally include the subject matter of Example 4, wherein the substantially linear top leg seam is approximately parallel to a sagittal plane of the body.

Example 6 can optionally include the subject matter of Example 2, wherein the top leg seam is sewn to the body.

Example 7 can optionally include the subject matter of Example 1, wherein the leg pocket opening faces a sagittal plane of the body.

Example 8 can optionally include the subject matter of Example 1, wherein the body defines an anterior opening and the head defines a head opening that coupled to the anterior opening of the body, wherein the body plush extends through the head opening in communication with the head.

Example 9 can optionally include the subject matter of Example 1, including a tail coupled to the body posteriorly.

Example 10 can optionally include the subject matter of Example 9, wherein the body defines a posterior opening and the tail defines a tail opening that coupled to the posterior opening of the body, wherein the body plush extends through the tail opening in communication with an interior volume of the tail.

Example 11 can optionally include the subject matter of Example 1, wherein the head pocket opening is formed in a shape of a mouth.

Example 12 can optionally include the subject matter of Example 11, including a bottom head portion coupled with the body along a neck seam, and a top head portion coupled to the bottom head portion, with the top head portion and the bottom head portion defining a mouth opening.

Example 13 can optionally include the subject matter of Example 12, wherein the mouth opening extends from a first corner on one side of the head to a second corner on an opposite side of the head.

Example 14 can optionally include the subject matter of Example 13, wherein the top head portion and the bottom head portion are hinged between the first corner and the second corner.

Example 15 can optionally include the subject matter of Example 11, wherein the recloseable head fastener includes a zipper.

Example 16 can optionally include the subject matter of Example 15, wherein the zipper is oriented to resemble teeth of the mouth.

Example 17 can optionally include the subject matter of Example 11, including a tongue coupled to the head on a ventral surface of the mouth.

Example 18 can optionally include the subject matter of Example 17, wherein the tongue defines a tongue pocket with a tongue pocket opening oriented posteriorly.

Example 19 can optionally include the subject matter of Example 1, wherein the body fabric, the head fabric and the leg fabric are formed of soft boa formed of polyester, the soft boa of a length of 5 millimeters and a width of around 1.47 meters.

Example 20 can optionally include the subject matter of Example 1, wherein the at least one of the legs includes stitching to bulge the leg along an anterior surface into a shape of at least two adjacent paw digits.

Example 21 can optionally include the subject matter of Example 1, wherein the at least one of the legs includes a bottom portion, with stitching extending from the bottom portion to an interior portion of the leg to maintain the bottom portion in a generally planar shape with respect to a remainder of the at least one of the legs.

Example 22 can optionally include the subject matter of Example 1, wherein the head, body and at least one pair of legs, together, define a quadruped shape.

Example 23 can optionally include the subject matter of Example 22, wherein the body pocket opening is positioned dorsally on the body.

Example 24 can optionally include the subject matter of Example 1, wherein the body includes a dorsal seam extending dorsally along the body.

Example 25 can optionally include the subject matter of Example 24, wherein the body pocket opening is formed by the dorsal seam extending dorsally along the body.

Example 26 can optionally include the subject matter of Example 25, wherein the body is cylinder shaped, with a single seam extending dorsally, with an anterior seam disposed along an anterior portion of the body, and a posterior seam disposed along a posterior portion of the body.

Example 27 can optionally include the subject matter of Example 26, wherein the cylinder shape is a right circular cylinder shape.

Example 28 can optionally include the subject matter of Example 27, wherein the anterior seam is circular.

Example 29 can optionally include the subject matter of Example 28, wherein the posterior seam is circular.

Example 30 can optionally include the subject matter of Example 24, including a fin coupled to the body along the dorsal seam.

Example 31 can optionally include the subject matter of Example 1, including an identification pocket, including a transparent portion and formed of a generally stiff, flexible material formed into a substantially planar shape, disposed in the body pocket, with an identification pocket opening of the identification pocket coupled proximal the body pocket opening.

Example 32 includes a method, including: forming a body, including: excising body fabric; sewing the body fabric into a body shape; sewing a body pocket into the body shape, the pocket extending to a body pocket opening in the body fabric; sewing the body fabric into a body, with the body pocket disposed in an interior of the body;

coupling a body pocket fastener to the body proximal the body pocket opening, the body pocket fastener for maintaining the body pocket opening closed; and stuffing the body with body plush to fill the interior of the body; sewing a head onto the body, the head formed by: excising head fabric; sewing the head fabric into a head shape; sewing a head pocket into the head shape, the pocket extending to an head pocket opening in the head fabric; sewing the head fabric into a head, with the head pocket disposed in an interior of the head; and coupling a head pocket fastener to the head proximal the head pocket opening, the head pocket fastener for maintaining the head pocket opening closed; and stuffing the head with head plush to fill the interior of the head; and sewing a pair of legs onto the body bilaterally along a ventral portion of the body, with at least one leg formed by: excising leg fabric; sewing the leg fabric into a leg shape; sewing a leg pocket into the leg shape, the pocket extending to an leg pocket opening in the leg fabric; sewing the leg fabric into a leg, with the leg pocket disposed in an interior of the leg; and coupling a leg pocket fastener to the leg proximal the leg pocket opening, the leg pocket fastener for maintaining the leg pocket opening closed; and stuffing the leg with leg plush to fill the interior of the leg.

Example 33 can optionally include the subject matter of example 32, wherein excising the body fabric includes excising an anterior opening in the body, wherein excising the head fabric includes excising a posterior opening in the head and wherein sewing the head onto the body includes sewing such that the anterior opening in the body and the posterior opening in the head are substantially coextensive, with plush extending from the head into the body.

Example 34 can optionally include the subject matter of example 32, including stuffing each of the legs with leg plush separately contained from the plush of the head and the body.

Example 35 can optionally include the subject matter of example 32, wherein sewing the body fabric into a body includes defining a head opening.

Example 36 can optionally include the subject matter of example 32, including sewing the leg plush into the leg before attaching the leg to the body.

Example 37 can optionally include the subject matter of example 32, including sewing a bottom head portion onto the body fabric.

Example 38 can optionally include the subject matter of example 32, including sewing extra fabric along a dorsal seam.

Example 39. A method, including: forming a plurality of bodies, wherein forming each body includes: excising body fabric and forming a body out of the body fabric, the body fabric having a different color than a remainder of the plurality of bodies; sewing a body pocket into the body, the pocket extending to a body pocket opening in the body fabric; sewing the body fabric into a body, with the body pocket disposed in an interior of the body;

coupling a body pocket fastener to the body proximal the body pocket opening, the body pocket fastener for maintaining the body pocket opening closed; and stuffing the body with body plush to fill the interior of the body; forming a plurality of heads, each head attachable to each of the plurality of bodies, with each head formed by: excising head fabric and forming a head out of the head fabric, the head fabric having a different color than a remainder of the plurality of heads; sewing a head pocket into the head, the pocket extending to an head pocket opening in the head fabric; sewing the head fabric into a head, with the head pocket disposed in an interior of the head; and coupling a head pocket fastener to the head proximal the head pocket opening, the head pocket fastener for maintaining the head pocket opening closed; and stuffing the head with head plush to fill the interior of the head; forming a plurality of pairs of legs, with each pair of legs attachable to any of the plurality of bodies, bilaterally along a ventral portion of the respective body, with at least one leg of each pair of legs formed by: excising leg fabric and forming a leg out of the leg fabric, the leg fabric having a different color than a remainder of the plurality of pairs of legs; sewing a leg pocket into the leg, the pocket extending to an leg pocket opening in the leg fabric; sewing the leg fabric into a leg, with the leg pocket disposed in an interior of the leg; and coupling a leg pocket fastener to the leg proximal the leg pocket opening, the leg pocket fastener for maintaining the leg pocket opening closed; and stuffing the leg with leg plush to fill the interior of the leg; and forming a plurality of unique toys using the same production method, with at least one of the unique toys formed of the body, head and leg, and another of the plurality of unique toys formed of another body of the plurality of bodies, another head of the plurality of heads, and another pair of legs of the plurality of pairs of legs.

Example 40 can optionally include the subject matter of example 39, wherein each leg of the plurality of legs is sewn to maintain plush inside the leg before attachment to a body of the plurality of bodies.

Example 41. A method, including: directing an automated sewing station to sew legs, a custom head and a custom tail onto a standard torso; selecting a custom head having a standard head interface mateable to a head interface of the standard torso; selecting a custom tail having a standard tail interface mateable to a tail interface of the standard torso; supplying the custom head and tail to the automated sewing machine; and sewing the legs, custom head and custom tail onto the standard torso.

Example 42 can optionally include the subject matter of example 41, wherein the legs are custom legs including respective leg interfaces mateable to a matching standard leg interface of the standard torso.

Example 43 can optionally include the subject matter of example 41, including sewing plush into each of the legs, the plush contained in each of the legs, prior to sewing the legs onto the standard torso.

Example 44. A method, including: forming a pocket inside a body portion of a plush toy; randomizing a plurality of articles into a hopper; disposing one of the plurality of articles, selected randomly, into the pocket of the body; and packaging the plush toy for retail sale.

Example 45 can optionally include the subject matter of example 44, including disposing another of the plurality of articles into a leg pocket of the plush toy.

Example 46 can optionally include the subject matter of example 44, including disposing another of the plurality of articles into a head pocket of the plush toy.

Example 47 can optionally include the subject matter of example 44, wherein packaging the plush toy includes covering the pocket of the body with packaging material.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Examples such as method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

This detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. This detailed description is, therefore, not to be taken in a limiting sense, and the scope is defined only by the appended claims, along with the full scope of legal equivalents to which such claims are entitled.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A plush toy apparatus, comprising:

a body formed of body fabric, the body defining a body pocket opening;

a body pocket disposed in an interior of the body and coupled to the body pocket opening;

body plush disposed in the interior of the body, between the body pocket and the body fabric;

a recloseable body fastener coupled to the body proximal the body pocket opening and configured to fasten the body pocket opening closed;

a head formed of head fabric, the head having a posterior portion of the head coupled to the body at an anterior portion of the body, the head defining a head pocket opening disposed on an anterior portion of the head;

a head pocket disposed in an interior of the head and coupled to the head pocket opening, wherein the head pocket opening is formed in a shape of a mouth;

head plush disposed in the interior of the head, between the head pocket and the head fabric;

a tongue coupled to the head on a ventral surface of the mouth, wherein the tongue defines a tongue pocket with a tongue pocket opening oriented posteriorly;

a recloseable head fastener coupled to the head proximal the head pocket opening and configured to fasten the head pocket opening closed; and a first pair of legs fastened to the body bilaterally along a ventral portion of the body, and a second pair of legs fastened to the body bilaterally along a ventral portion of the body, wherein each respective leg of the first and second pairs of legs comprises:

a leg fabric configured in a leg shape;

leg plush disposed in an interior of the leg shape; and a magnet disposed in the interior of the leg shape.

2. The apparatus of claim 1, wherein at least one leg of the first and second pairs of legs comprises a leg pocket disposed in the interior of said at least one leg.

3. The apparatus of claim 2, wherein the magnet disposed in said at least one leg is a component of a recloseable fastener coupled to said at least one leg proximal the leg opening to close the leg opening.

4. The apparatus of claim 1, wherein the first and second pairs of legs define front legs and rear legs so as to define a plush toy quadruped shape selected from the group consisting of a dog, a horse, a giraffe, a dinosaur, a turtle, a unicorn, a hippopotamus, a bear, a pig, and a monkey.

5. The apparatus of claim 4, wherein the head pocket opening is formed in a shape of a mouth of said plush toy quadruped shape, wherein the recloseable head fastener includes a zipper oriented to resemble teeth of the mouth.

6. The apparatus of claim 5, wherein the zipper oriented to resemble teeth of the mouth includes a soft pull comprising felt material or a fleece material.

7. The apparatus of claim 6, wherein the body fabric, the head fabric, and the leg fabric comprise a polyester material that is different from the material of the soft pull.

8. The apparatus of claim 1, wherein each respective leg of the first and second pairs of legs includes a top leg seam that retains the leg plush inside the each respective leg of the first and second pairs of legs leg and separates the leg plush from the body plush.

9. The apparatus of claim 8, wherein the top leg seam is a substantially linear top leg seam.

10. The apparatus of claim 9, wherein the substantially linear top leg seam is approximately parallel to a sagittal plane of the body.

11. The apparatus of claim 1, comprising a tail coupled to the body posteriorly.

12. The apparatus of claim 1, wherein the recloseable head fastener includes a zipper.

13. The apparatus of claim 12, wherein the zipper is oriented to resemble teeth of the mouth.

14. The apparatus of claim 1, wherein at least one leg of the first and second pairs of legs includes a bottom portion, with stitching extending from the bottom portion to an interior portion of said at least one leg to maintain the bottom portion in a generally planar shape with respect to a remainder of said at least one leg.

15. A plush toy apparatus, comprising:

a body formed of body fabric, the body defining a body pocket opening;

a body pocket disposed in an interior of the body and coupled to the body pocket opening;

body plush disposed in the interior of the body, between the body pocket and the body fabric;

a recloseable body fastener coupled to the body proximal the body pocket opening and configured to fasten the body pocket opening closed;

a head formed of head fabric, the head having a posterior portion of the head coupled to the body at an anterior portion of the body, the head defining a head pocket opening disposed on an anterior portion of the head;

a tongue coupled to the head on a ventral surface of the mouth, wherein the tongue defines a tongue pocket;

a head pocket disposed in an interior of the head and coupled to the head pocket opening;

head plush disposed in the interior of the head, between the head pocket and the head fabric;

a recloseable head fastener coupled to the head proximal the head pocket opening and configured to fasten the head pocket opening closed; and at least one pair of legs formed of leg fabric and fastened to the body bilaterally along a ventral portion of the body, wherein at least one leg of the pair of legs comprises:

a leg fabric configured in a leg that defines a leg pocket opening;

a leg pocket disposed in the interior of the leg and coupled to the leg opening; and leg plush disposed in the interior of the leg between the leg pocket and the leg.

16. The apparatus of claim 15, wherein the leg includes a top leg seam that retains the leg plush inside the leg and separates the leg plush from the body plush.

17. The apparatus of claim 16, wherein the top leg seam is a substantially linear top leg seam.

18. The apparatus of claim 17, wherein the substantially linear top leg seam is approximately parallel to a sagittal plane of the body.

19. The apparatus of claim 1, wherein the leg pocket opening faces a sagittal plane of the body.

20. The apparatus of claim 1, comprising a tail coupled to the body posteriorly.

21. The apparatus of claim 1, wherein the head pocket opening is formed in a shape of a mouth.

22. The apparatus of claim 21, wherein the recloseable head fastener includes a zipper.

23. The apparatus of claim 22, wherein the zipper is oriented to resemble teeth of the mouth.

24. The apparatus of claim 21, wherein the tongue defines a tongue pocket with a tongue pocket opening oriented posteriorly.

25. The apparatus of claim 1, wherein said at least one leg of the pair of legs further comprises a recloseable leg fastener coupled to the leg proximal the leg opening to close the leg opening.

26. The apparatus of claim 1, wherein said at least one leg of the pair of legs includes a bottom portion, with stitching extending from the bottom portion to an interior portion of the leg to maintain the bottom portion in a generally planar shape with respect to a remainder of the at least one of the legs.

27. The apparatus of claim 1, comprising an identification pocket, including a transparent portion and formed of a generally stiff, flexible material formed into a substantially planar shape, disposed in the body pocket, with an identification pocket opening of the identification pocket coupled proximal the body pocket opening.

28. The apparatus of claim 15, wherein said at least one pair of legs comprises two pairs of legs formed of the leg fabric and fastened to the body along the ventral portion of the body, the two pairs of leg defining front legs and rear legs so as to define a plush toy quadruped shape, wherein each respective leg of said two pairs of legs comprises a leg pocket disposed in the interior of the respective leg, and wherein said plush toy quadruped shape contains at least six pockets, said at least six pockets including the body pocket, the head pocket, and four legs pockets of two pairs of legs.

29. The apparatus of claim 28, wherein each respective leg of said two pairs of legs further comprises a recloseable leg fastener coupled to the respective leg proximal the leg opening to close the leg opening, wherein the recloseable fasteners corresponding to said at least six pockets include fasteners selected from the group consisting of hook-and-loop fasteners, snaps, zippers, zip-lock seals, and magnets.

30. The apparatus of claim 28, wherein the two pairs of leg define the front legs and the rear legs so as to define the plush toy quadruped shape selected from the group consisting of a dog, a horse, a giraffe, a dinosaur, a turtle, a unicorn, a hippopotamus, a bear, a pig, and a monkey.

31. The apparatus of claim 28, wherein the head pocket opening is formed in a shape of a mouth of said plush toy quadruped shape, wherein the recloseable head fastener includes a zipper oriented to resemble teeth of the mouth.

32. The apparatus of claim 31, wherein the zipper oriented to resemble teeth of the mouth includes a soft pull comprising felt material or a fleece material, and wherein the body fabric, the head fabric, and the leg fabric comprise a polyester material that is different from the material of the soft pull.

33. A plush toy apparatus, comprising:

a body formed of body fabric, the body defining a body pocket opening;

a body pocket disposed in an interior of the body and coupled to the body pocket opening;

body plush disposed in the interior of the body, between the body pocket and the body fabric;

a head formed of head fabric, the head having a posterior portion of the head coupled to the body at an anterior portion of the body, the head defining a head pocket opening disposed on an anterior portion of the head;

a head pocket disposed in an interior of the head and coupled to the head pocket opening;

head plush disposed in the interior of the head, between the head pocket and the head fabric;

a first pair of legs fastened to the body bilaterally along a ventral portion of the body, and a second pair of legs fastened to the body bilaterally along a ventral portion of the body, wherein each respective leg of the first and second pairs of legs comprises:

a leg fabric configured in a leg that defines a leg pocket opening;

a leg pocket disposed in the interior of the leg and coupled to the leg opening; and leg plush disposed in the interior of the leg between the leg pocket and the leg.

* * * * *